US006164004A

United States Patent [19]

Essary

[11] Patent Number: 6,164,004

[45] Date of Patent: Dec. 26, 2000

[54] PROTECTIVE COVER

[76] Inventor: Timothy Essary, Rte. 5 Box 320 A, Corinth, Miss. 38834

[21] Appl. No.: 09/204,487

[22] Filed: Dec. 3, 1998

[51] Int. Cl.[7] ..... F41A 35/02

[52] U.S. Cl. ..... 42/96

[58] Field of Search ..... 42/96; 33/244; 206/317; 150/154; 602/26, 27

[56] References Cited

U.S. PATENT DOCUMENTS

| | | | |
|---|---|---|---|
| 35,456 | 6/1862 | Leverich | 42/96 |
| 2,364,340 | 12/1944 | Bogg, Jr. | 42/96 |
| 2,932,334 | 4/1960 | Steen | 42/96 |
| 4,328,634 | 5/1982 | Wiltrout | 42/96 |
| 4,348,829 | 9/1982 | Bosco et al. | 42/96 |
| 4,398,367 | 8/1983 | Gamble et al. | 42/96 |
| 4,433,500 | 2/1984 | Kunevicius | 42/96 |
| 4,817,322 | 4/1989 | Dietz et al. | 42/96 |
| 4,858,361 | 8/1989 | White | 42/96 |
| 4,860,479 | 8/1989 | Easter | 42/96 |

FOREIGN PATENT DOCUMENTS

| | | | |
|---|---|---|---|
| 490916 | 5/1919 | France | 42/96 |
| 22182 | 5/1921 | France | 42/96 |
| 22346 | 6/1921 | France | 42/96 |
| 74933 | 11/1918 | Germany | 42/96 |
| 23895 | 8/1915 | United Kingdom | 42/96 |
| 12087 | 6/1916 | United Kingdom | 42/96 |

*Primary Examiner*—Darren W. Ark

[57] ABSTRACT

A protective cover for the firing mechanism of a muzzle loading rifle. The device includes a tubular sleeve having a lumen and opposite first and second ends. Each of the ends of the sleeve has an opening into the lumen of the sleeve which are adapted for inserting a rifle through them into the lumen of the sleeve such that an external firing mechanism of the rifle is covered by the sleeve. The first and second ends of the sleeve each have an annular elastic band extending around them.

6 Claims, 3 Drawing Sheets

FIG. 4
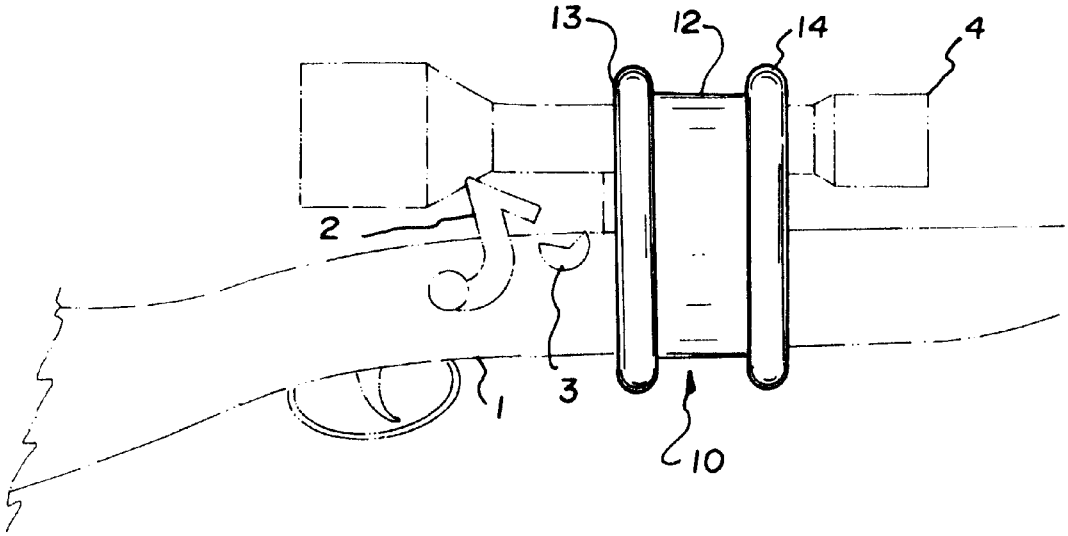
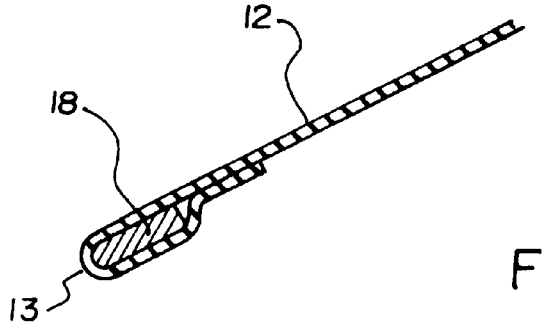
FIG. 5

PROTECTIVE COVER

BACKGROUND OF THE INVENTION

1. Field of the Invention

The present invention relates to firing mechanism protectors for muzzle loading rifles and more particularly pertains to a new protective cover for the firing mechanism of a muzzle loading rifle.

2. Description of the Prior Art

The use of firing mechanism protectors for muzzle loading rifles is known in the prior art. More specifically, firing mechanism protectors for muzzle loading rifles heretofore devised and utilized are known to consist basically of familiar, expected and obvious structural configurations, notwithstanding the myriad of designs encompassed by the crowded prior art which have been developed for the fulfillment of countless objectives and requirements.

Known prior art firing mechanism protectors for muzzle loading rifles include U.S. Pat. No. 4,348,829; U.S. Pat. No. 4,398,367; U.S. Pat. No. 4,328,634; U.S. Pat. No. 4,817,322; U.S. Pat. No. 4,858,361; and U.S. Pat. No. 4,433,500.

While these devices fulfill their respective, particular objectives and requirements, the aforementioned patents do not disclose a new protective cover. The inventive device includes a tubular sleeve having a lumen and opposite first and second ends. Each of the ends of the sleeve has an opening into the lumen of the sleeve which are adapted for inserting a rifle through them into the lumen of the sleeve such that an external firing mechanism of the rifle is covered by the sleeve. The first and second ends of the sleeve each have an annular elastic band extending around them.

In these respects, the protective cover according to the present invention substantially departs from the conventional concepts and designs of the prior art, and in so doing provides an apparatus primarily developed for the purpose of the firing mechanism of a muzzle loading rifle.

SUMMARY OF THE INVENTION

In view of the foregoing disadvantages inherent in the known types of firing mechanism protectors for muzzle loading rifles now present in the prior art, the present invention provides a new protective cover construction wherein the same can be utilized for the firing mechanism of a muzzle loading rifle.

The general purpose of the present invention, which will be described subsequently in greater detail, is to provide a new protective cover apparatus and method which has many of the advantages of the firing mechanism protectors for muzzle loading rifles mentioned heretofore and many novel features that result in a new protective cover which is not anticipated, rendered obvious, suggested, or even implied by any of the prior art firing mechanism protectors for muzzle loading rifles, either alone or in any combination thereof.

To attain this, the present invention generally comprises a tubular sleeve having a lumen and opposite first and second ends. Each of the ends of the sleeve has an opening into the lumen of the sleeve which are adapted for inserting a rifle through them into the lumen of the sleeve such that an external firing mechanism of the rifle is covered by the sleeve. The first and second ends of the sleeve each have an annular elastic band extending around them.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new protective cover apparatus and method which has many of the advantages of the firing mechanism protectors for muzzle loading rifles mentioned heretofore and many novel features that result in a new protective cover which is not anticipated, rendered obvious, suggested, or even implied by any of the prior art firing mechanism protectors for muzzle loading rifles, either alone or in any combination thereof.

It is another object of the present invention to provide a new protective cover which may be easily and efficiently manufactured and marketed.

It is a further object of the present invention to provide a new protective cover which is of a durable and reliable construction.

An even further object of the present invention is to provide a new protective cover which is susceptible of a low cost of manufacture with regard to both materials and labor, and which accordingly is then susceptible of low prices of sale to the consuming public, thereby making such protective cover economically available to the buying public.

Still yet another object of the present invention is to provide a new protective cover which provides in the apparatuses and methods of the prior art some of the advantages thereof, while simultaneously overcoming some of the disadvantages normally associated therewith.

Still another object of the present invention is to provide a new protective cover for the firing mechanism of a muzzle loading rifle.

Yet another object of the present invention is to provide a new protective cover which includes a tubular sleeve having a lumen and opposite first and second ends. Each of the ends of the sleeve has an opening into the lumen of the sleeve which are adapted for inserting a rifle through them into the lumen of the sleeve such that an external firing mechanism of the rifle is covered by the sleeve. The first and second ends of the sleeve each have an annular elastic band extending around them.

Still yet another object of the present invention is to provide a new protective cover that keeps the firing mechanism of a muzzle loading rifle dry during wet weather conditions.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a schematic side view of the present invention on a rifle having a telescopic sight above its firing mechanism with the ends of the sleeve rolled up.

FIG. 5 is a schematic sectional view of an end of the present invention taken from line 5—5 on FIG. 2.

DESCRIPTION OF THE PREFERRED EMBODIMENT

Figure 1:
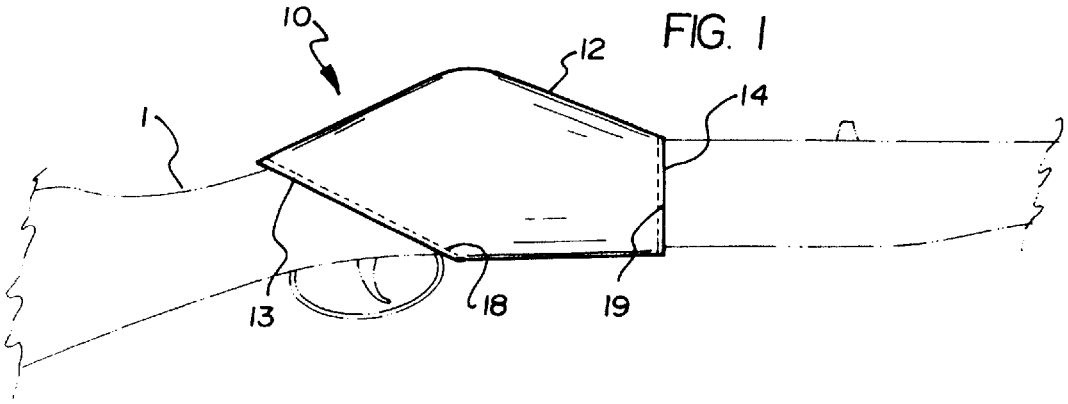
FIG. 1 is a schematic side view of a new protective cover on the firing mechanism of a muzzle loading rifle according to the present invention.

With reference now to the drawings, and in particular to FIGS. 1 through 6 thereof, a new protective cover embodying the principles and concepts of the present invention and generally designated by the reference numeral 10 will be described.

As best illustrated in FIGS. 1 through 6, the protective cover 10 generally comprises a tubular sleeve 12 having a lumen and opposite first and second ends 13,14. Each of the ends 13,14 of the sleeve 12 has an opening 15,16 into the lumen of the sleeve 12 which are adapted for inserting a rifle 1 through them into the lumen of the sleeve 12 such that an external firing mechanism of the rifle 1 is covered by the sleeve 12. The first and second ends 13,14 of the sleeve 12 each have an annular elastic band 18,19 extending around them.

Figure 6:
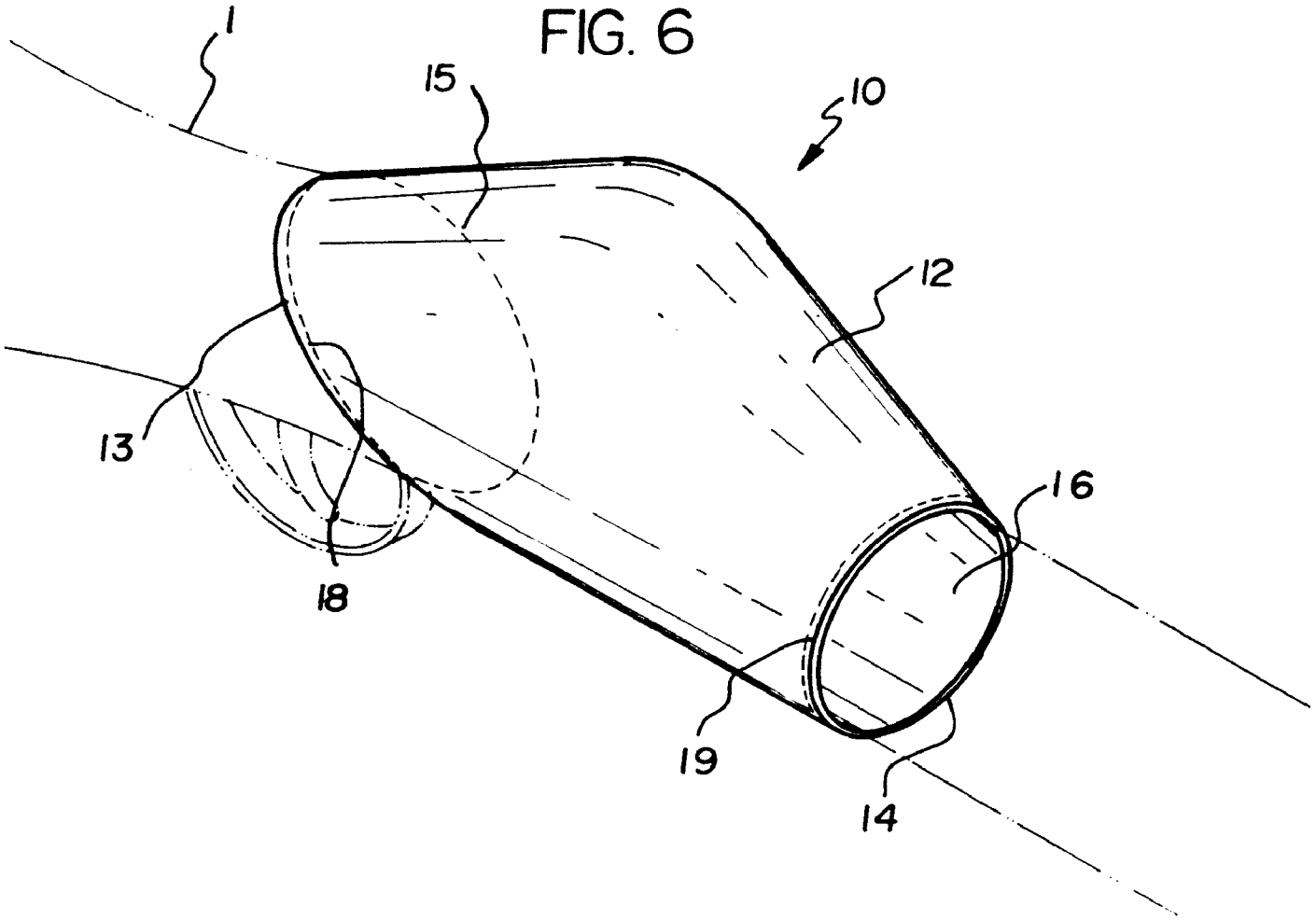
FIG. 6 is a schematic perspective view of the present invention in use.

In use, the protective cover 10 is designed for protecting the external firing mechanism of a muzzle loading rifle 1 so that the mechanism and the gun powder are kept dry during wet weather conditions. The firing mechanism preferably included a hammer 2 and a firing pan 3. In closer detail, the protective cover 10 comprises a tubular sleeve 12 having a lumen and opposite first and second ends 13,14. The longitudinal axis of the sleeve 12 extends between its first and second ends 13,14. The first and second ends 13,14 of the sleeve 12 each have an opening 15,16 into the lumen of the sleeve 12. The openings 15,16 each have an outer periphery and are adapted for inserting a rifle 1 therethrough into the lumen of the sleeve 12 such that the external firing mechanism of the rifle 1 is disposed in the lumen and covered by the sleeve 12 as illustrated in FIGS. 1 and 6. Preferably, the outer periphery of the opening 15 of the first end 13 of the sleeve 12 lies in a plane oriented at an oblique angle with respect to the longitudinal axis of the sleeve 12 such that the outer periphery of the opening 15 of the first end 13 of the sleeve 12 is generally oval. In this preferred embodiment, the outer periphery of the opening 16 of the second end 14 of the sleeve 12 lies in a plane substantially perpendicular with the longitudinal axis of the sleeve 12 such that the outer periphery of the opening 16 of the second end 14 of the sleeve 12 is generally circular.

The first and second ends 13,14 of the sleeve 12 each have an annular elastic band 18,19 extending therearound the outer periphery of their associated opening. With reference to FIG. 5, each end has a folded over portion to form an annular channel into which their elastic band is stitched into. Preferably, the sleeve 12 also comprises a flexible and elastic material such that the sleeve 12 may conform to the general outline of the firing mechanism of a muzzle loading rifle 1 inserted into the lumen of sleeve 12 (see FIG. 1) and even if the rifle 1 has a telescopic sight 4 (see FIG. 4). It is also preferred that the sleeve 12 is constructed for a water proof material resistant to the passage of water therethrough, and in particular from the exterior into the lumen.

Figure 2:
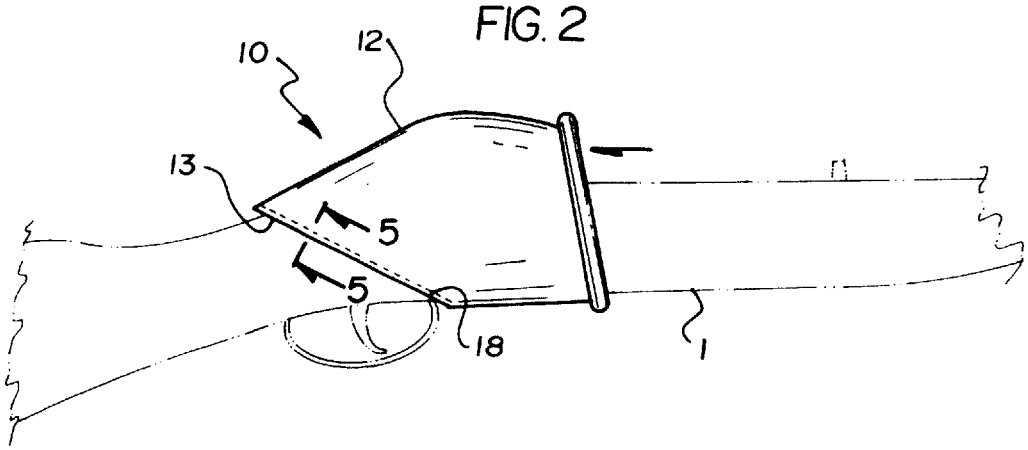
FIG. 2 is a schematic side view of the present invention with an end being rolled over the sleeve.
Figure 3:
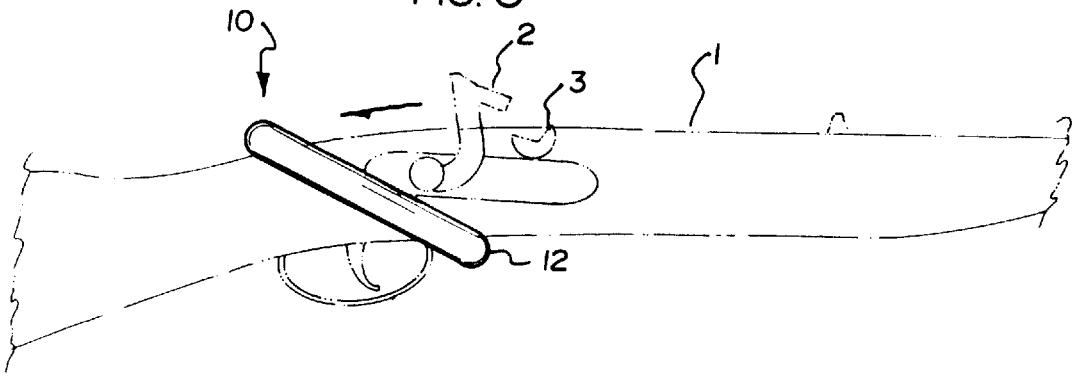
FIG. 3 is a schematic side view of the present invention with an end being rolled over the sleeve so that the firing mechanism of the rifle is exposed.

In use, a rifle is inserted into lumen of the sleeve and the sleeve is positioned so that the sleeve covers the external firing mechanism of the rifle as shown in FIG. 1. The elastic bands close the openings around the barrel of the rifle so that moisture cannot pass into the lumen thereby keeping the firing mechanism dry. The ends of the sleeve may be rolled back over the sleeve to expose the firing mechanism (as shown in FIGS. 2 and 3) from either end of the sleeve (as shown in FIG. 4)

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A protective cover for the external firing mechanism of a rifle, said protective cover comprising:

a tubular sleeve having opposite first and second ends, a lumen, and opposite first and second sides;

said first and second ends of said sleeve each having an opening into said lumen of said sleeve, said openings of said first and second ends each having an outer periphery;

said openings of said ends of said sleeve being adapted for inserting a rifle therethrough into said lumen of said sleeve such that an external firing mechanism of the rifle is covered by said sleeve;

said first and second ends of said sleeve each having an annular elastic band extending therearound;

wherein said sleeve has a longitudinal axis extending between said first and second ends of said sleeve, said first and second sides of said sleeve extending between top portions and bottom portions respectively of said outer peripheries of said openings of said first and second ends, said first side being longer in length than the second side, and said outer periphery of said opening of said first end of said sleeve lying in a plane oriented at an oblique angle with respect with said longitudinal axis of said sleeve; and wherein said oblique angle of said opening of said first end of said sleeve is adapted for extending from a trigger guard of the rifle over a stock of the rifle such that the trigger is actuatable by a hand of a user, said sleeve being rollable such that said sleeve may be rolled from said second end of said sleeve to said first end of said sleeve whereby hindrance of the operation and sighting of the rifle is prevented.

2. The protective cover of claim 1, wherein said outer periphery of said opening of said second end of said sleeve lying in a plane substantially perpendicular with said longitudinal axis of said sleeve.

3. The protective cover of claim 1, wherein each of said elastic bands extends around the outer periphery of the associated opening of the associated end.

4. The protective cover of claim 1, wherein said sleeve comprises a flexible and elastic material.

5. The protective cover of claim 1, wherein said sleeve comprises a material resistant to the passage of water therethrough.

6. A protective cover for the external firing mechanism of a muzzle loading rifle, said protective cover comprising:

a tubular sleeve having opposite first and second ends, a lumen, and opposite first and second sides;

said sleeve having a longitudinal axis extending between said first and second ends of said sleeve;

said first and second ends of said sleeve each having an opening into said lumen of said sleeve, said openings of said first and second ends each having an outer periphery, said first and second sides of said sleeve extending between top portions and bottom portions respectively of said outer peripheries of said openings of said first and second ends, said first side being longer in length than the second side;

said openings of said ends of said sleeve being adapted for inserting a rifle therethrough into said lumen of said sleeve such that an external firing mechanism of the rifle is covered by said sleeve;

said outer periphery of said opening of said first end of said sleeve lying in a plane oriented at an oblique angle with respect to said longitudinal axis of said sleeve such that said outer periphery of said opening of said first end of said sleeve is generally oval;

said outer periphery of said opening of said second end of said sleeve lying in a plane substantially perpendicular with said longitudinal axis of said sleeve such that said opening of said second end of said sleeve is generally circular;

said first and second ends of said sleeve each having an annular elastic band extending therearound the outer periphery of the associated opening of the end, each end having a folded over portion to form an annular channel into which said elastic band is stitched into;

wherein said sleeve comprises a flexible and elastic material such that said sleeve may conform to the general outline of the muzzle loading rifle inserted into said lumen of said sleeve;

wherein said sleeve comprises a material resistant to the passage of water therethrough; and wherein said oblique angle of said opening of said first end of said sleeve is adapted for extending from a trigger guard of the muzzle loading rifle over a stock of the muzzle loading rifle such that the trigger is actuatable by a hand of a user, said sleeve being rollable such that said sleeve may be rolled from said second end of said sleeve to said first end of said sleeve whereby hindrance of the operation and sighting of the muzzle loading rifle is prevented.

* * * * *